US010814188B2

(12) United States Patent
Suzuki et al.

(10) Patent No.: US 10,814,188 B2
(45) Date of Patent: Oct. 27, 2020

(54) TENNIS RACKET

(71) Applicant: SUMITOMO RUBBER INDUSTRIES, LTD., Hyogo (JP)

(72) Inventors: Fumiya Suzuki, Hyogo (JP); Yosuke Yamamoto, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/378,655

(22) Filed: Apr. 9, 2019

(65) Prior Publication Data

US 2019/0329102 A1 Oct. 31, 2019

(30) Foreign Application Priority Data

Apr. 25, 2018 (JP) ..... 2018-083991

(51) Int. Cl.

| | |
|---|---|
| ***A63B 51/00*** | (2015.01) |
| ***A63B 51/02*** | (2015.01) |
| *A63B 102/02* | (2015.01) |
| *A63B 49/02* | (2015.01) |

(52) U.S. Cl.

CPC ..... *A63B 51/02* (2013.01); *A63B 49/02* (2013.01); *A63B 51/023* (2020.08); *A63B 2102/02* (2015.10)

(58) Field of Classification Search

CPC ... A63B 51/02; A63B 51/00; A63B 2051/023; A63B 2102/02; A63B 49/02; A63B 51/023

See application file for complete search history.

(56) References Cited

U.S. PATENT DOCUMENTS

| | | | | | |
|---|---|---|---|---|---|
| 1,173,712 | A * | 2/1916 | DuBois | A63B 51/02 | 473/543 |
| 1,542,177 | A * | 6/1925 | Rose | A63B 49/022 | 473/540 |
| 4,013,289 | A * | 3/1977 | Kaminstein | A63B 51/00 | 473/537 |
| 4,231,575 | A * | 11/1980 | Kutt | A63B 51/00 | 473/531 |
| 4,330,125 | A * | 5/1982 | Sassler | A63B 49/00 | 473/521 |

(Continued)

FOREIGN PATENT DOCUMENTS

| | | | | |
|---|---|---|---|---|
| EP | 3560559 | A1 * | 10/2019 | A63B 51/02 |
| JP | 2002-306639 | A1 | 10/2002 | |
| WO | WO-2016023881 | A1 * | 2/2016 | A63B 51/00 |

*Primary Examiner* — Raleigh W Chiu

(74) *Attorney, Agent, or Firm* — Greenblum & Bernstein, P.L.C.

(57) ABSTRACT

In a tennis racket, longitudinal strings extending in a longitudinal direction and transverse strings extending in a transverse direction intersect each other to form a plurality of meshes. At a center, in the transverse direction, of a head, a ratio of an area St of a tip mesh located closest to a tip in the longitudinal direction relative to an area Sc of a center mesh located at a center in the longitudinal direction is not less than. The center mesh is formed in a rectangular shape having short sides in the longitudinal direction and long sides in the transverse direction. Preferably, from the center mesh to the tip mesh, an area of each mesh is set so as to be not larger than an area of a mesh adjacent thereto at a tip side.

19 Claims, 5 Drawing Sheets

(56) References Cited

U.S. PATENT DOCUMENTS

| | | | | | |
|---|---|---|---|---|---|
| 4,512,575 | A * | 4/1985 | Tzeng | A63B 51/00 | 473/537 |
| 5,277,422 | A * | 1/1994 | Coe | A63B 49/02 | 473/537 |
| 5,779,573 | A * | 7/1998 | You | A63B 49/02 | 473/543 |
| 8,808,121 | B2 * | 8/2014 | Severa | A63B 49/10 | 473/537 |
| 2006/0084532 | A1 * | 4/2006 | Chu | A63B 51/02 | 473/524 |
| 2008/0102995 | A1 * | 5/2008 | Chang | A63B 51/00 | 473/543 |
| 2014/0031150 | A1 * | 1/2014 | Severa | A63B 49/10 | 473/540 |
| 2017/0232308 | A1 * | 8/2017 | Germain | A63B 49/02 | 473/537 |
| 2019/0329102 | A1 * | 10/2019 | Suzuki | A63B 51/00 | |

* cited by examiner

TENNIS RACKET

This application claims priority on Patent Application No. 2018-83991 filed in JAPAN on Apr. 25, 2018. The entire contents of this Japanese Patent Application are hereby incorporated by reference.

BACKGROUND OF THE INVENTION

Field of the Invention

The present invention relates to tennis rackets.

Description of the Related Art

JP2002-306639 discloses a tennis racket having an enlarged sweet area. In the tennis racket, the length L1 of the minimum interval between longitudinal strings and the length L2 of the minimum interval between transverse strings are each set within a predetermined range, and the ratio (L2/L1) of the length L2 to the length L1 is further set to be not less than 1.50 and not greater than 2.80.

Conventionally, the mainstream swing in regulation-ball tennis is classical swing. In the classical swing, when a tennis racket hits a ball, the tennis racket is swung such that a hand grip portion and a tip portion thereof move substantially parallel to each other. Meanwhile, in recent years, modern swing is the mainstream swing. In the modern swing, when a tennis racket hits a ball, the tennis racket is swung such that a tip portion thereof moves faster than a hand grip portion thereof. In the modern swing, a ball is hit at the vicinity of the tip portion that moves fast, whereby the ball can be strongly hit.

In a conventional tennis racket, the sweet spot is located substantially at the center of the ball-hitting face. In the tennis racket, the resilience performance at the vicinity of a tip portion is inferior to that of a center portion. For the conventional tennis racket, there is room for improvement from the viewpoint of strongly hitting a ball at the vicinity of the tip portion. For the conventional tennis racket, there is also room for improvement from the viewpoint of application to the modern swing.

An object of the present invention is to provide a tennis racket having, at a tip side from the center of a ball-hitting face thereof, an area having high resilience performance.

SUMMARY OF THE INVENTION

In a tennis racket according to the present invention, longitudinal strings extending in a longitudinal direction and transverse strings extending in a transverse direction intersect each other to form a plurality of meshes. At a center, in the transverse direction, of a head, a ratio of an area St of a tip mesh located closest to a tip in the longitudinal direction relative to an area Sc of a center mesh located at a center in the longitudinal direction is not less than 1.6. The center mesh is formed in a rectangular shape having short sides in the longitudinal direction and long sides in the transverse direction.

Preferably, from the center mesh to the tip mesh, an area of each mesh is set so as to be not larger than an area of a mesh adjacent thereto at a tip side.

Preferably, from the center mesh to the tip mesh, the area of the mesh gradually increases from the center toward the tip.

Preferably, pitches between the longitudinal strings are constant in the transverse direction.

Resilience amounts at positions at which a distance Y from a top of the head is 6 cm, 9 cm, 12 cm, and 15 cm are denoted by $Hb_6$, $Hb_9$, $Hb_{12}$, and $Hb_{15}$, respectively. In this case, preferably, among the resilience amounts $Hb_6$, $Hb_9$, $Hb_{12}$, and $Hb_{15}$, a minimum resilience amount is not less than 0.98 times of a maximum resilience amount.

Preferably, the area Sc of the center mesh is not less than 70 $mm^2$.

Preferably, a number of the longitudinal strings is not less than 16 and not greater than 18, and a number of the transverse strings is not less than 18 and not greater than 20.

In the tennis racket according to the present invention, since the center mesh is formed in a rectangular shape, the ratio (St/Sc) of the area St of the tip mesh to the area Sc of the center mesh is increased without extremely decreasing the area of the center mesh. Since the ratio (St/Sc) is increased, high resilience performance is exhibited at the tip side.

DESCRIPTION OF THE PREFERRED EMBODIMENTS

The following will describe in detail the present invention based on preferred embodiments with appropriate reference to the drawings.

Figure 1:
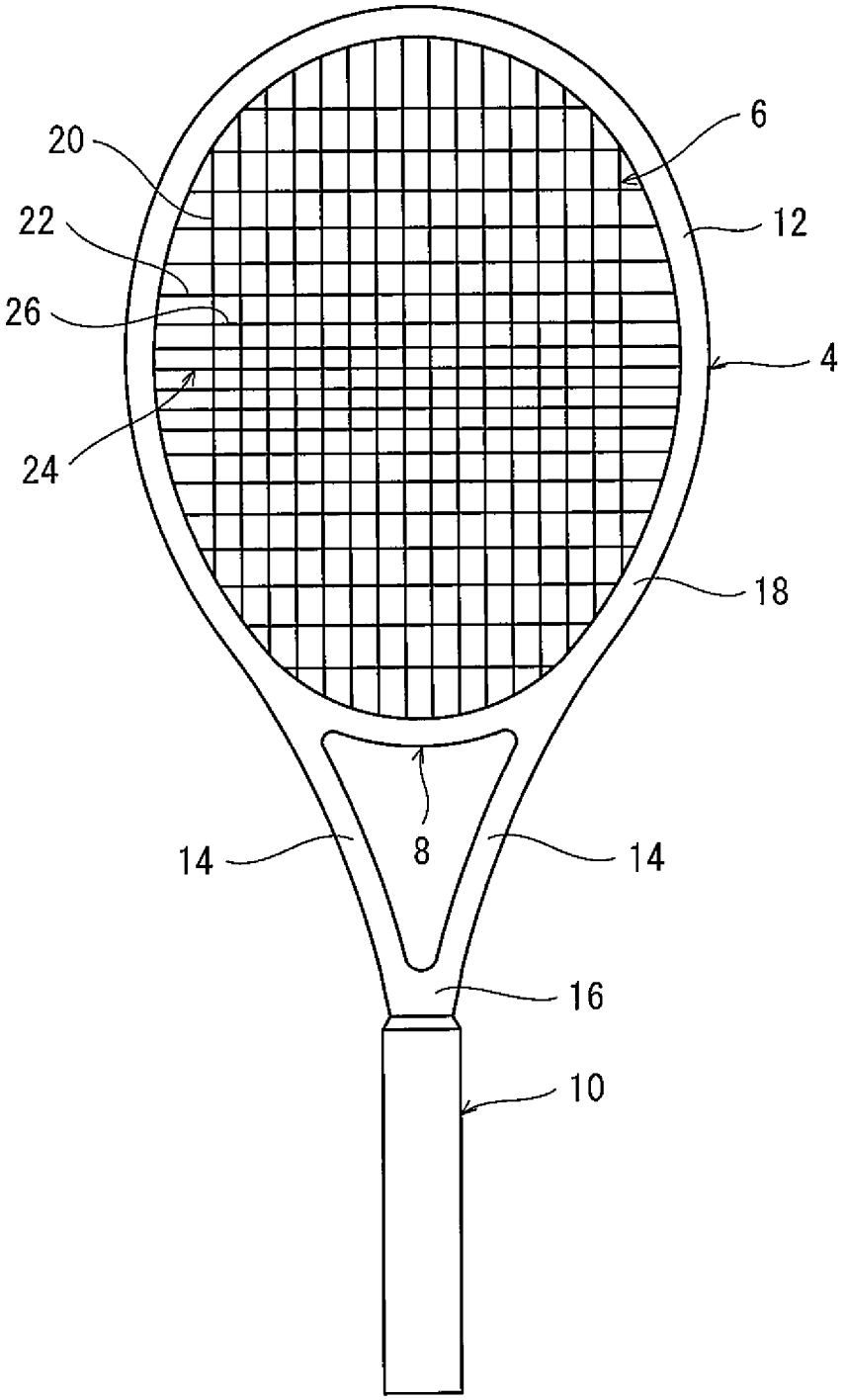
FIG. 1 is a front view of a tennis racket according to an embodiment of the present invention.

FIG. 1 shows a tennis racket 2 according to the present invention. The tennis racket 2 includes a racket frame 4, a string 6, a yoke 8, and a grip 10. The tennis racket 2 is used for regulation-ball tennis. In FIG. 1, the up-down direction is the longitudinal direction of the tennis racket 2, the right-left direction is the transverse direction of the tennis racket 2, and a direction perpendicular to the surface of the sheet is the thickness direction of the tennis racket 2.

The racket frame 4 includes a head 12, a pair of throats 14, and a shaft 16. The head 12, the pair of throats 14, and the shaft 16 are connected to each other. The head 12 extends in a curved manner so as to be bent back at the upper side. A pair of lower ends of the head 12 are connected to each other via the yoke 8. In this manner, the head 12 and the yoke 8 form an annular portion 18 having a substantially elliptical shape.

Each throat 14 extends downward from the lower end of the head 12. The throats 14 extend toward the shaft 16 in directions in which the throats 14 come close to each other. Both end portions of the racket frame 4 extend downward further from the pair of throats 14. Both end portions are joined to each other. The joined end portions form the shaft 16. The grip 10 is formed at the outer side of the shaft 16.

The string 6 is stretched on the annular portion 18 of the racket frame 4. The string 6 stretched on the annular portion 18 forms a plurality of longitudinal strings 20 and a plurality of transverse strings 22. These longitudinal strings 20 and these transverse strings 22 form a ball-hitting face 24. The ball-hitting face 24 has a substantially elliptical shape surrounded by the annular portion 18. The major axis direction of the ball-hitting face 24 is the longitudinal direction of the tennis racket 2. The minor axis direction of the ball-hitting face 24 is the transverse direction of the tennis racket 2.

In the tennis racket 2, the string 6 forms, for example, 16 longitudinal strings 20, and, for example, 19 transverse strings 22. Each longitudinal string 20 extends in the longitudinal direction inside the annular portion 18. Each transverse string 22 extends in the transverse direction inside the annular portion 18. These longitudinal strings 20 and these transverse strings 22 intersect each other to form a plurality of meshes 26. The shape of each mesh 26 is a quadrangle surrounded by the longitudinal strings 20 and the transverse strings 22.

Figure 2:
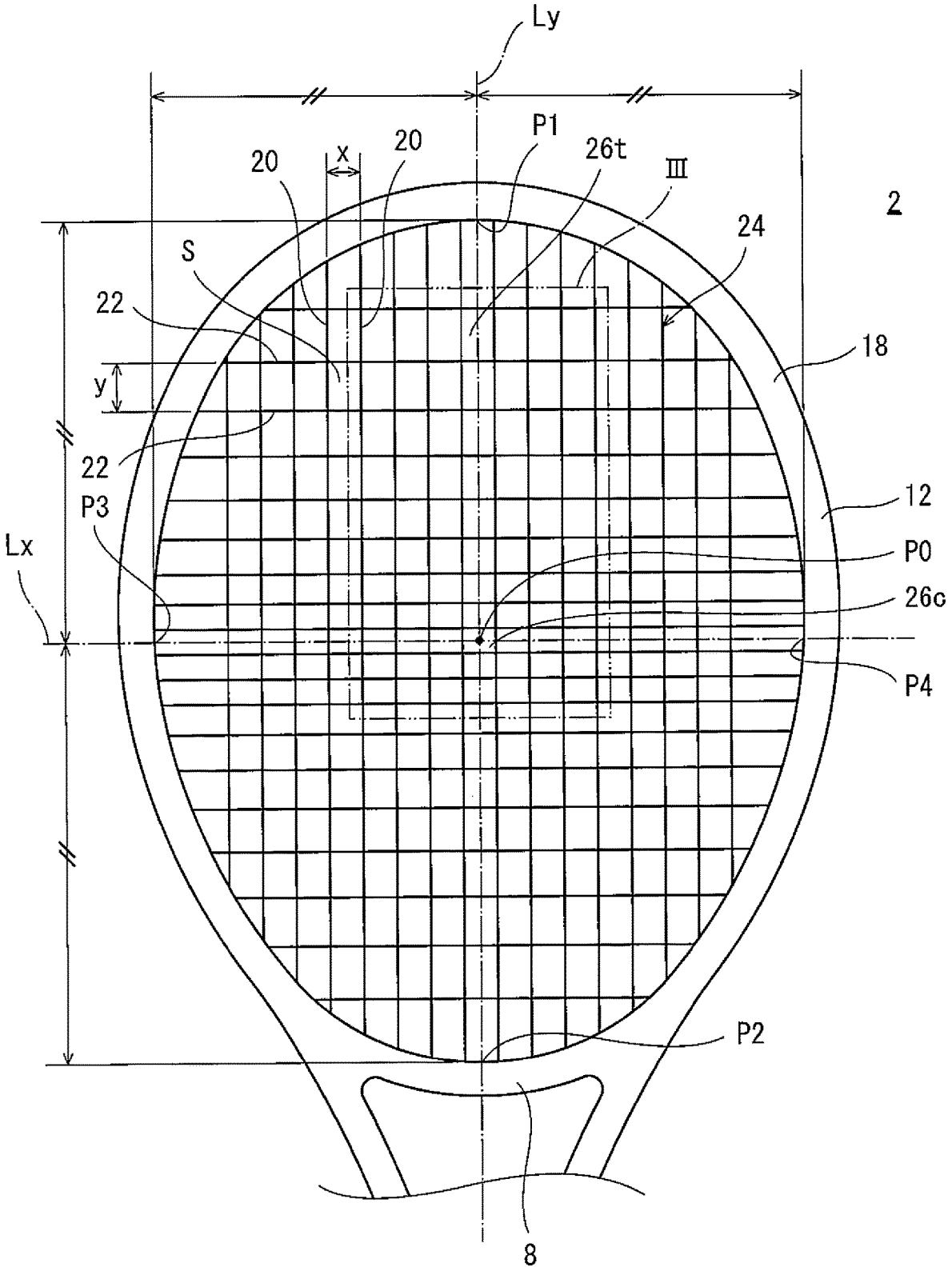
FIG. 2 is a partially enlarged view of the tennis racket in FIG. 1.

FIG. 2 shows the longitudinal strings 20 and the transverse strings 22 stretched on the annular portion 18. In FIG. 2, an alternate long and short dash line Ly represents a center line of the ball-hitting face 24 that extends in the longitudinal direction of the head 12. The center line Ly extends through the center, in the transverse direction, of the head 12. The center line Ly is also a straight line that passes through a position at which the dimension, in the longitudinal direction, of the ball-hitting face 24 is at its maximum. An alternate long and short dash line Lx represents a center line of the ball-hitting face 24 that extends in the transverse direction of the head 12. In FIG. 2, reference character P0 represents the center position of the ball-hitting face 24. The center position P0 represents the midpoint of a line segment extending on the ball-hitting face 24, of the center line Ly. The center line Lx is a straight line that passes through the center position P0 and extends in the transverse direction.

A point P1 represents the point of intersection of the annular portion 18 (head 12) and the center line Ly at the upper side. In the present invention, the point P1 is also referred to as a top of the head 12. A point P2 represents the point of intersection of the annular portion 18 (yoke 8) and the center line Ly. A point P3 represents one point of intersection of the annular portion 18 (head 12) and the center line Lx in the transverse direction. A point P4 represents the other point of intersection of the annular portion 18 (head 12) and the center line Lx in the transverse direction.

In FIG. 2, a double-headed arrow x represents the interval between the longitudinal strings 20 in the transverse direction. The interval x is measured as the interval between the axes of the longitudinal strings 20 adjacent to each other in the transverse direction. A double-headed arrow y represents the interval between the transverse strings 22 in the longitudinal direction. The interval y is measured as the interval between the axes of the transverse strings 22 adjacent to each other in the longitudinal direction. Reference character S represents the area of a quadrangle formed by the longitudinal strings 20 and the transverse strings 22. The area S is obtained as the product of the interval x and the interval y. In the present invention, the area S is referred to as area of the mesh 26.

In the present invention, the mesh 26 in which the center position P0 is located, among a large number of meshes 26, is referred to as a center mesh 26*c*. In addition, in the present invention, at the center in the transverse direction, the mesh 26 that is closest to the top (point P1) of the head 12 is referred to as a tip mesh 26*t*.

Figure 3:
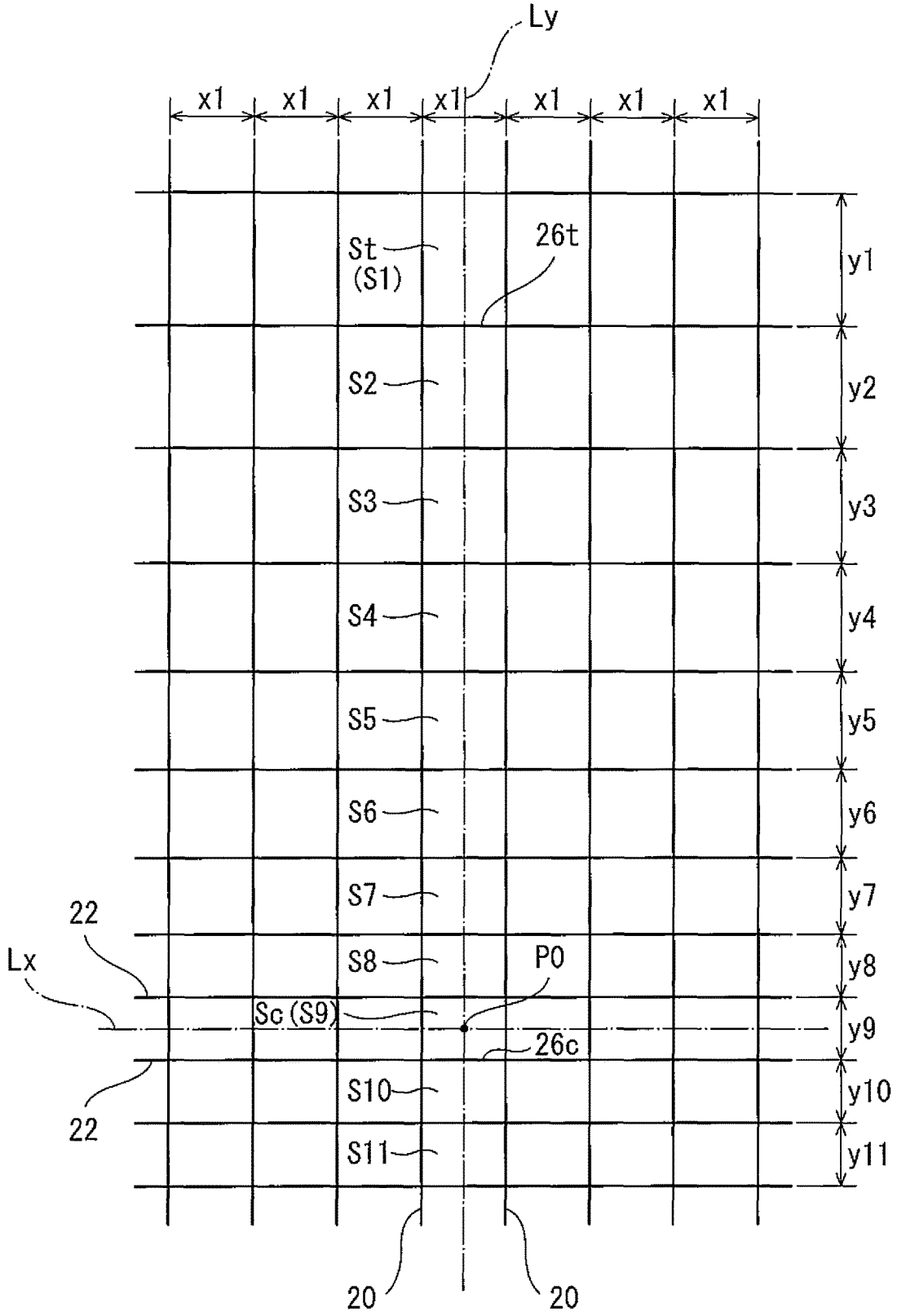
FIG. 3 is an enlarged view of an area surrounded by an alternate long and two short dashes line III in FIG. 2.

FIG. 3 shows an enlarged view of an area surrounded by an alternate long and two short dashes line III in FIG. 2. In FIG. 3, double-headed arrows y1 to y11 represent the magnitudes of the longitudinal intervals y at the respective meshes 26. The longitudinal intervals y are specified in order of y1 to y11 from the tip side toward the hand grip side. Although not shown, the longitudinal intervals y are further specified as y12, y13, and y14 from Y11 toward the hand grip side. In the tennis racket 2, the double-headed arrow y1 represents the longitudinal interval y at the tip mesh 26*t*. The double-headed arrow y9 represents the longitudinal interval y at the center mesh 26*c*.

In the tennis racket 2, the longitudinal intervals y8 to y11 are set so as to have the same magnitude. The longitudinal interval y gradually increases from the longitudinal interval y8 toward the longitudinal interval y1. Similarly, the longitudinal interval y gradually increases from the longitudinal interval y11 toward the hand grip side.

In FIG. 3, each double-headed arrow x1 represents the magnitude of the transverse interval x between the longitudinal strings 20. In the tennis racket 2, in the transverse direction, from one end to the other end thereof in the transverse direction, the transverse intervals x between the longitudinal strings 20 are set so as to be uniform as a transverse interval x1. The transverse interval x at the center mesh 26*c* and the transverse interval x at the tip mesh 26*t* are also each set to a transverse interval x1.

In FIG. 3, reference characters S1 to S11 represent the areas S of the respective meshes 26. The areas S are specified in order of S1 to S11 from the tip side toward the hand grip side. Although not shown, the areas S are further specified as S12, S13, and S14 from S11 toward the hand grip side. In the tennis racket 2, the area S1 represents the area St of the tip mesh 26*t*. The area S9 represents the area Sc of the center mesh 26*c*.

In the tennis racket 2, the areas S8, S9, S10, and S11 are set so as to have the same magnitude. In other words, the areas S8, S10, and S11 are set so as to have the same magnitude as the area Sc. Furthermore, the area S gradually increases from the area S8 toward the area St. Similarly, the area S gradually increases from the area S11 toward the hand grip side.

Figure 4:
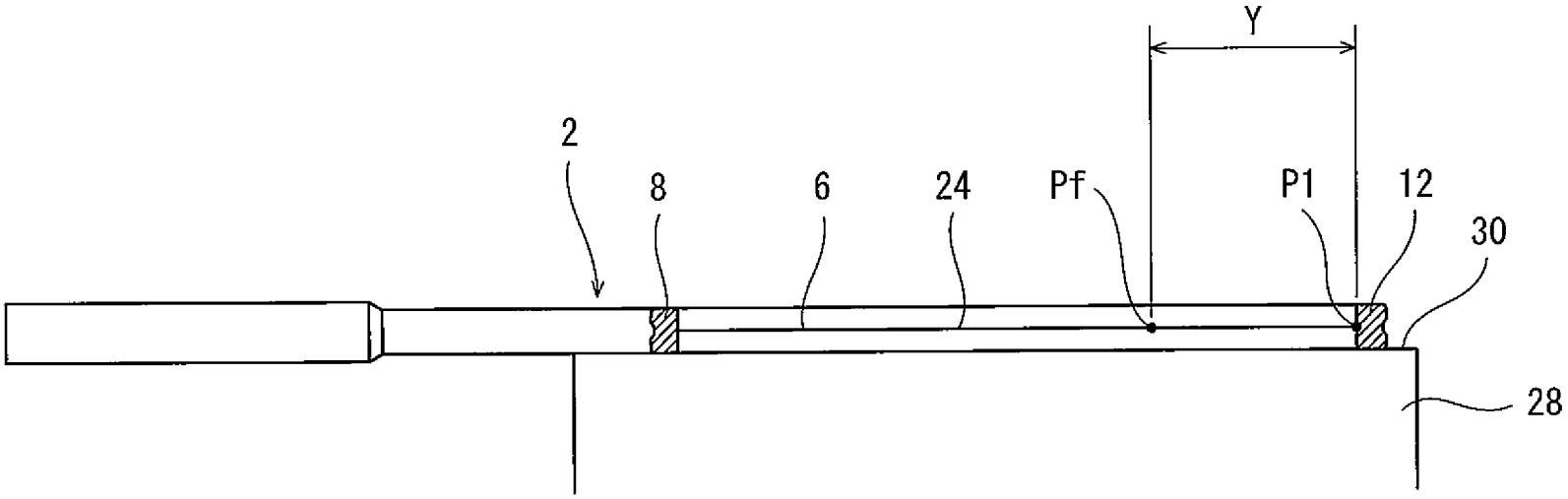
FIG. 4 is an explanatory diagram for a testing method for the tennis racket in FIG. 1.

FIG. 4 is an explanatory diagram for a testing method for resilience performance. The testing method for the resilience performance of the tennis racket 2 will be described with reference to FIG. 4.

The tennis racket 2 is placed on a test stand 28. The test stand 28 has a flat placement surface 30. The placement surface 30 is a flat surface that extends in the horizontal direction. The head 12 and the yoke 8 are placed on the placement surface 30. The tennis racket 2 is placed such that the ball-hitting face 24 is parallel to the placement surface 30. In other words, the tennis racket 2 is placed such that the longitudinal strings 20 and the transverse strings 22 extend parallel to the placement surface 30. The tennis racket 2 is fixed to the test stand 28 by a cramp that is not shown.

In FIG. 4, reference character Pf represents a point located on the ball-hitting face 24. The point Pf is located on the straight line Ly. A double-headed arrow Y represents the distance from the top (point P1) of the head 12 to the point Pf. The distance Y is measured along the ball-hitting face 24 in the longitudinal direction.

In the testing method for resilience performance, a tennis ball is caused to freely fall from a position having a predetermined height H from the ball-hitting face 24 at the position of the distance Y. The tennis ball that has collided against the ball-hitting face 24 at the point Pf is rebounded. A resilience amount Hb of the rebounded tennis ball is measured. The resilience amount Hb is obtained as a maximum reach height of the tennis ball. The resilience amount Hb is obtained as a height from the ball-hitting face 24. The ratio (Hb/H) of the height Hb to the height H may be obtained. The ratio (Hb/H) is used as resilience performance. When the ratio (Hb/H) is greater, the resilience performance is higher. In this testing method, a tennis ball that complies with the ITF standards is used. In the testing method for resilience performance, the height H is set to 254 cm. The heights H and Hb are each measured as a distance from the ball-hitting face 24 to the lower position (lower end position) of the tennis ball. The heights H and Hb are each measured as a direct distance in the thickness direction of the tennis racket 2.

Figure 5:
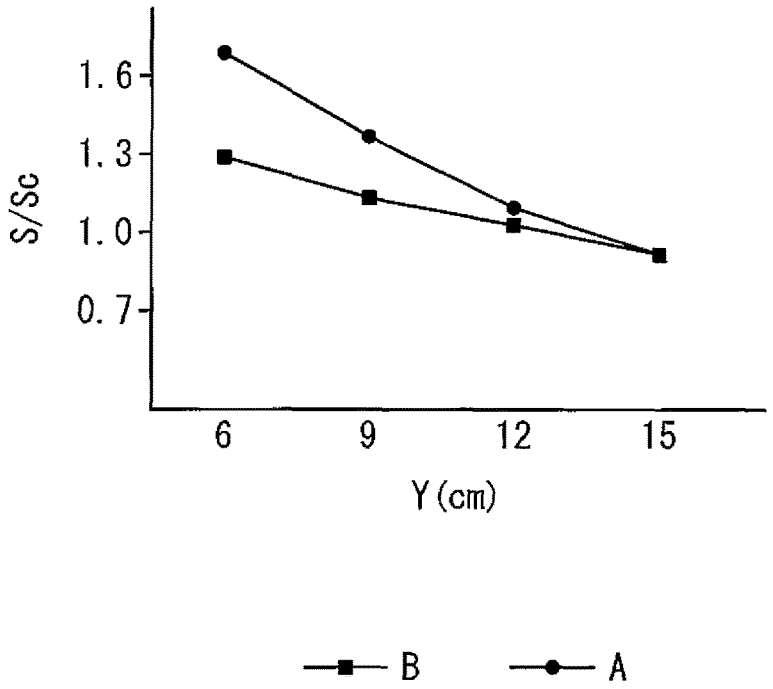
FIG. 5 is a graph showing a relationship between a position from a top and an area ratio of each mesh in each of the tennis racket in FIG. 1 and a conventional tennis racket.

FIG. 5 shows a graph of a relationship between a distance Y from the top and an area ratio (S/Sc) in each of the tennis racket 2 and a conventional tennis racket. In FIG. 5, A is a graph of the area ratio (S/Sc) in the tennis racket 2, and B is a graph of the area ratio (S/Sc) in a commercially-available tennis racket as the conventional tennis racket. In the tennis racket 2, the center mesh 26*c* is located at a position at which the distance Y is 15 cm. Also in the conventional tennis racket, a center mesh is located at a position at which the distance Y is 15 cm. The ratio (S/Sc) is obtained as the ratio of the area S of the mesh 26 located at the distance Y, relative to the area Sc of the center mesh 26*c*.

As shown in FIG. 5, in the tennis racket 2, the area ratio (S/Sc) increases as the position approaches the top from the center mesh 26*c*. The area ratio (S/Sc) in the tennis racket 2 is greater at the tip side than that in the conventional tennis racket.

A mesh 26 having a large area S can bend more greatly when a tennis ball collides with the tennis racket 2, than a mesh 26 having a small area S. The greater bending produces greater resilient force. In the tennis racket 2, resilience performance at the tip side is improved by increasing the area ratio (S/Sc).

Figure 6:
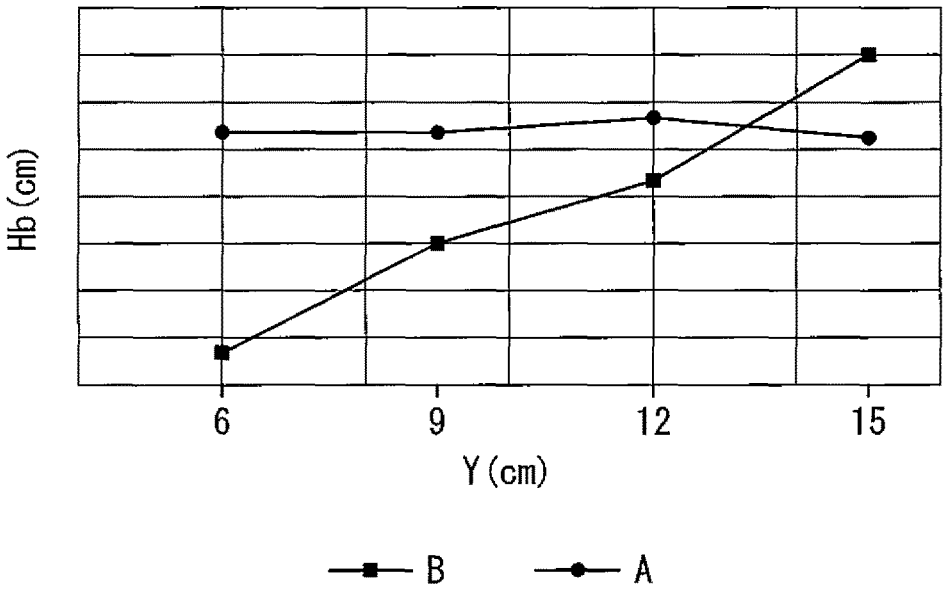
FIG. 6 is a graph showing a relationship between a position from the top and a resilience amount in each of the tennis racket in FIG. 1 and the conventional tennis racket.

FIG. 6 shows a relationship between a distance Y from the top and a resilience amount. FIG. 6 is obtained through measurement by the testing method for resilience performance in FIG. 4. In FIG. 6, A is a graph of the resilience amount Hb of the tennis racket 2, and B is a graph of the resilience amount Hb of the commercially-available tennis racket. In the tennis racket 2, the resilience amount Hb increases from the lower side toward the upper side.

In the tennis racket 2, a resilience amount $Hb_6$ at a position at which the distance Y from the top is 6 cm, a resilience amount $Hb_9$ at a position at which the distance Y from the top is 9 cm, and a resilience amount $Hb_{12}$ at a position at which the distance Y from the top is 12 cm are each larger than a resilience amount $Hb_{15}$ at the position at which the distance Y is 15 cm. In the tennis racket 2, the resilience amount $Hb_6$, the resilience amount $Hb_9$, and the resilience amount $Hb_{12}$ at the tip side of the ball-hitting face 24 are larger than the resilience amount $Hb_{15}$ at the center mesh 26*c*. On the other hand, in the conventional tennis racket, the resilience amount Hb decreases as the distance Y from the top decreases.

In the tennis racket 2, the longitudinal interval y9 at the center mesh 26*c* is set so as to be less than the transverse interval x1 at the center mesh 26*c*. Although not shown, the magnitude of the longitudinal interval at the center mesh is generally set so as to be greater than that of the transverse interval at the center mesh in the conventional tennis racket. Accordingly, in the tennis racket 2, the ratio (St/Sc) of the area St at the tip mesh 26*t* to the area Sc at the center mesh 26*c* can be greater than that in the conventional tennis racket.

In the tennis racket 2, the ratio (St/Sc) is increased and set so as to be not less than 1.6. In the tennis racket 2, the ratio (St/Sc) is greater than that in the conventional tennis racket. In the tennis racket 2 having a great ratio (St/Sc), high resilience performance is obtained at the vicinity of the tip mesh 26*t*. The tennis racket 2 can strongly hit a ball at the vicinity of the tip portion.

The area S of the mesh 26 preferably increases gradually from the center side toward the tip side. In other words, from the center mesh 26*c* to the tip mesh 26*t*, the area S of the mesh 26 preferably increases gradually from the center toward the tip. Accordingly, a sudden change in resilience performance is inhibited. Thus, the resilience performance is made uniform from the center of the ball-hitting face 24 to the vicinity of the tip.

In the tennis racket 2, the area Sc of the center mesh 26*c*, the area S8 of the mesh 26 adjacent to the center mesh 26*c* at the tip side, the area S10 of the mesh 26 adjacent to the center mesh 26*c* at the hand grip side, and the area S11 of the mesh 26 adjacent to the mesh 26 having the area S10 at the hand grip side are set so as to have the same magnitude. In the present invention, the area S does not necessarily have to gradually increase from the center mesh 26*c* to the tip mesh 26*t*. From the viewpoint of making the resilience uniform, the areas S of meshes 26 adjacent to each other in the longitudinal direction may be partially set so as to be equal to each other. Furthermore, from the viewpoint of obtaining high resilience at the tip side, the area St of the tip mesh 26*t* only needs to be larger than the area Sc of the center mesh 26*c*, and the area S of each mesh 26 only needs to be not larger than the area S of the mesh 26 adjacent thereto at the tip side.

The conventional tennis racket is configured such that the transverse interval x gradually increases from the center side toward the outer side in the transverse direction. In the tennis racket 2, the longitudinal strings 20 are stretched at equal intervals x1 from one end toward the other end in the transverse direction. In other words, the pitches between the longitudinal strings 20 are constant. Accordingly, the area Sc of the center mesh 26*c* is inhibited from becoming extremely small even when the longitudinal interval y9 at the center mesh 26*c* is decreased. A mesh 26 having an excessively small area S decreases the resilience performance. In the tennis racket 2, even when the longitudinal interval y is decreased, since the longitudinal strings 20 are stretched at equal intervals x1, the resilience performance is not greatly deteriorated. The tennis racket according to the present invention is not limited to a tennis racket in which the transverse intervals x between the longitudinal strings 20 are equal. In the tennis racket, the transverse interval x may gradually increase or gradually decrease from the center side toward the outer side in the transverse direction.

From the viewpoint of inhibiting resilience performance from being deteriorated at the vicinity of the center mesh 26*c*, the area Sc of the center mesh 26*c* is preferably not less than 70 $mm^2$, further preferably not less than 90 $mm^2$, and particularly preferably not less than 110 $mm^2$.

Furthermore, uniform resilience performance is obtained from the center to the vicinity of the tip by decreasing the differences among the resilience amount $Hb_6$, the resilience amount $Hb_9$, the resilience amount $Hb_{12}$, and the resilience amount $Hb_{15}$. From the viewpoint of obtaining uniform resilience performance, among the resilience amount $Hb_6$, the resilience amount $Hb_9$, the resilience amount $Hb_{12}$, and the resilience amount $Hb_{15}$, the minimum resilience amount is preferably not less than 0.98 times of the maximum resilience amount.

The tennis racket 2 has excellent resilience performance at the tip side. The tennis racket 2 is particularly suitable for modern swing.

From the viewpoint of increasing the resilience performance at the tip side, the present invention is particularly suitable for the tennis racket 2 in which the longitudinal width of the annular portion 18 is larger than the transverse width thereof.

The tennis racket 2 has a string pattern composed of 16 longitudinal strings 20 and 19 transverse strings 22, but the string pattern according to the present invention is not limited thereto. For example, the present invention can be similarly applied to a tennis racket having a string pattern composed of 16 longitudinal strings 20 and 18 transverse strings 22, 16 longitudinal strings 20 and 20 transverse strings 22, or the like. The present invention is suitable in the case where the number of longitudinal strings 20 is not less than 16 and not greater than 18 and the number of transverse strings 22 is not less than 18 and not greater than 20.

EXAMPLES

The following will show the effects of the present invention by means of examples, but the present invention should not be construed in a limited manner based on the description of these examples.

[Comparison Test]

Example 1

A tennis racket A shown in FIG. 1 was prepared. The face size, the string pattern, the center position, and the area ratio (S/Sc) of each mesh to the center mesh of the tennis racket A were as shown in Table 1. The string pattern of the racket frame A was formed from 16 longitudinal strings and 19 transverse strings. In Table 1, M1 represents the first mesh from the tip side. In the tennis racket A, the first to eighteenth meshes were formed as M1 to M18 from the tip side toward the hand grip side. M9 at the center position represents that the ninth mesh from the tip side is the center mesh.

Examples 2 and 3

Tennis rackets B and C in each of which the face size, the string pattern, the center position, and the area ratio (S/Sc) of each mesh were as shown in Table 1 were prepared.

Comparative Examples 1 to 10

Commercially-available tennis rackets D to M were prepared. The face sizes, the string patterns, the center positions, and the area ratios (S/Sc) of each mesh of these tennis rackets were as shown in Tables 1 and 2.

TABLE 1

Evaluation Results

| | | Ex. 1 | Ex. 2 | Ex. 3 | Comp. Ex. 1 | Comp. Ex. 2 | Comp. Ex. 3 | Comp. Ex. 4 |
|---|---|---|---|---|---|---|---|---|
| Tennis racket | | A | B | C | D | E | F | G |
| Face size | | 98 | 95 | 95 | 98 | 98 | 98 | 97 |
| String pattern | | 16 * 19 | 16 * 19 | 18 * 20 | 16 * 19 | 16 * 19 | 16 * 19 | 16 * 20 |
| Center position | | M9 | M10 | M11 | M9 | M10 | M10 | M12 |
| Ratio S/Sc | M1 | 1.83 | 1.77 | 1.71 | 1.52 | 1.48 | 1.11 | 1.27 |
| | M2 | 1.55 | 1.55 | 1.67 | 1.27 | 1.20 | 1.11 | 1.18 |
| | M3 | 1.40 | 1.40 | 1.55 | 1.23 | 1.08 | 1.04 | 1.14 |
| | M4 | 1.35 | 1.35 | 1.40 | 1.18 | 1.04 | 1.00 | 1.14 |
| | M5 | 1.30 | 1.30 | 1.30 | 1.18 | 1.00 | 1.00 | 1.14 |
| | M6 | 1.20 | 1.20 | 1.20 | 1.09 | 0.96 | 0.96 | 1.05 |
| | M7 | 1.10 | 1.10 | 1.10 | 1.09 | 1.00 | 0.96 | 1.05 |
| | M8 | 1.00 | 1.00 | 1.05 | 1.00 | 1.04 | 0.96 | 1.00 |
| | M9 | 1.00 | 1.00 | 1.05 | 1.00 | 1.04 | 1.00 | 1.00 |
| | M10 | 1.00 | 1.00 | 1.00 | 1.00 | 1.00 | 1.00 | 1.00 |
| | M11 | 1.00 | 1.00 | 1.00 | 1.00 | 1.00 | 1.00 | 1.00 |
| | M12 | 1.10 | 1.10 | 1.00 | 1.09 | 1.00 | 1.00 | 1.00 |
| | M13 | 1.25 | 1.15 | 1.05 | 1.09 | 1.00 | 1.04 | 1.05 |
| | M14 | 1.30 | 1.20 | 1.10 | 1.18 | 1.00 | 1.00 | 1.05 |
| | M15 | 1.45 | 1.25 | 1.15 | 1.27 | 1.00 | 1.04 | 1.14 |
| | M16 | 1.50 | 1.35 | 1.30 | 1.30 | 1.00 | 1.04 | 1.18 |
| | M17 | 1.60 | 1.40 | 1.50 | 1.41 | 1.12 | 1.15 | 1.32 |
| | M18 | 2.00 | 1.60 | 1.70 | 1.85 | 1.36 | 1.41 | 1.50 |
| | M19 | — | — | 2.07 | — | — | — | 1.91 |

TABLE 2

Evaluation Results

| | | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|
| Tennis racket | | H | I | J | K | L | M |
| Face size | | 95 | 95 | 98 | 100 | 98 | 98 |
| String pattern | | 16 * 19 | 16 * 19 | 16 * 19 | 16 * 18 | 16 * 20 | 16 * 19 |
| Center position | | M9 | M10 | M10 | M10 | M10 | M10 |
| Ratio | M1 | 1.42 | 1.54 | 1.53 | 1.31 | 1.29 | 1.31 |

TABLE 2-continued

| Evaluation Results | | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|
| S/Sc | M2 | 1.21 | 1.23 | 1.51 | 1.31 | 1.13 | 1.11 |
| | M3 | 1.17 | 1.22 | 1.50 | 1.23 | 0.96 | 1.04 |
| | M4 | 1.08 | 1.18 | 1.41 | 1.23 | 0.96 | 1.00 |
| | M5 | 1.08 | 1.18 | 1.32 | 1.15 | 0.96 | 1.00 |
| | M6 | 1.00 | 1.09 | 1.23 | 1.12 | 0.92 | 0.96 |
| | M7 | 0.96 | 1.07 | 1.14 | 1.08 | 0.92 | 0.96 |
| | M8 | 0.96 | 1.00 | 1.05 | 1.04 | 0.96 | 0.96 |
| | M9 | 1.00 | 1.00 | 1.00 | 1.00 | 0.96 | 1.00 |
| | M10 | 1.00 | 1.00 | 1.00 | 1.00 | 1.00 | 1.00 |
| | M11 | 0.96 | 1.00 | 1.09 | 1.04 | 1.00 | 1.00 |
| | M12 | 1.00 | 1.09 | 1.18 | 1.08 | 1.00 | 1.00 |
| | M13 | 1.04 | 1.09 | 1.32 | 1.15 | 1.00 | 1.04 |
| | M14 | 1.00 | 1.16 | 1.45 | 1.27 | 1.08 | 1.00 |
| | M15 | 1.00 | 1.16 | 1.50 | 1.42 | 1.13 | 1.04 |
| | M16 | 1.04 | 1.25 | 1.55 | 1.56 | 1.25 | 1.04 |
| | M17 | 1.04 | 1.34 | 1.57 | 1.56 | 1.25 | 1.15 |
| | M18 | 1.38 | 1.48 | 1.65 | — | 1.33 | 1.41 |
| | M19 | — | — | — | — | 1.58 | — |

In the tennis rackets of Examples 1 to 3, the ratios (St/Sc) of the tip mesh St to the center mesh Sc were 1.83, 1.77, and 1.71, respectively. On the other hand, in the tennis rackets of the Comparative Examples, the ratio (St/Sc) was at most 1.54. Also from this fact, it is obvious that, in the tennis racket according to the present invention, the ratio (S/Sc) is greater than that in the conventional tennis racket. From the viewpoint of exhibiting high resilience performance at the vicinity of the tip, the ratio (S/Sc) is preferably not less than 1.6 and further preferably not less than 1.7.

[Resilience Amount Test]

Example 1 and Comparative Examples 1 to 5

The aforementioned tennis racket A of Example 1 was prepared. In addition, the tennis rackets D to H of Comparative Examples 1 to 5 were prepared as examples of conventional commercially-available products.

[Evaluation of Resilience Performance]

These tennis rackets were evaluated for resilience performance by using the testing method for resilience performance in FIG. 4. In this testing method, the tension of the longitudinal strings was set to 50 (lbs), and the tension of the transverse strings was set to 45 (lbs). Three measurements were made for each tennis racket, and the average of measured values was obtained. The results are shown in Table 3. In each racket, among the resilience amount $Hb_6$ at a distance Y of 6 cm, the resilience amount $Hb_9$ at a distance Y of 9 cm, the resilience amount $Hb_{12}$ at a distance Y of 12 cm, and the resilience amount $Hb_{15}$ at a distance Y of 15 cm, with the maximum value being 1.00, the other resilience amounts are indicated as indexes.

TABLE 3

| Evaluation Results | | Ex. 1 | Comp. Ex. 1 | Comp. Ex. 2 | Comp. Ex. 3 | Comp. Ex. 4 | Comp. Ex. 5 |
|---|---|---|---|---|---|---|---|
| Tennis racket | | A | D | E | F | G | H |
| Resilience amount (cm) | Y6 | 0.987 | 0.968 | 0.972 | 0.963 | 0.962 | 0.969 |
| | Y9 | 0.998 | 0.993 | 0.984 | 0.982 | 0.995 | 0.991 |
| | Y12 | 1.00 | 1.00 | 1.00 | 0.988 | 1.00 | 0.998 |
| | Y15 | 0.996 | 0.995 | 0.991 | 1.00 | 0.982 | 1.00 |

As shown in Table 3, the tennis racket A of Example 1 has better resilience at the tip side than the conventional tennis rackets. In addition, the difference in resilience amount is decreased from the position at which the distance Y is 6 cm to the position at which the distance Y is 15 cm. Among the resilience amount $Hb_6$, the resilience amount $Hb_9$, the resilience amount $Hb_{12}$, and the resilience amount $Hb_{15}$, the minimum resilience amount $Hb_6$ is not less than 0.98 times of the maximum resilience amount $Hb_{12}$.

[Sensuous Test]

Example 4

A tennis racket N according to the present invention was prepared as Example 4. In the tennis racket N, the intervals between the longitudinal strings were made uniform, and the intervals between the transverse strings were small at the center side and gradually increased toward the outer side. In Table 4, M1, M3, M6, M9, M12, M15, and M18 each represent what number from the tip side the mesh is, similar to Table 1. In Table 4, the ratios (S/Sc) of the meshes of M1, M3, M6, M9, M12, M15, and M18 are shown.

Comparative Example 11

A tennis racket P of Comparative Example 11 was prepared as an example of a commercially-available product. In the tennis racket P, the intervals between the longitudinal strings and the intervals between the transverse strings were small at the center side and gradually increased toward the outer side. In Table 4, the ratios (S/Sc) of the meshes of M1, M3, M6, M9, M12, M15, and M18 of the tennis racket P are shown.

Comparative Examples 12 to 14

Tennis rackets Q, R, and S were produced in the same manner as Example 1, except the intervals between the longitudinal strings, the intervals between the transverse strings, and the ratio (S/Sc) were as shown in Table 4. In the tennis racket Q, the shape of each mesh was a square.

[Sensuous Evaluation]

An advanced player made sensuous evaluation for these tennis rackets. The advanced player made evaluations for the size of the sweet area, the magnitude of vibration transmitted to the hand, and ease of providing spin, and made an overall evaluation. The results are shown in Table 4. The results are each indicated as a value with the value of Comparative Example 11 being a reference value 50. A higher value indicates a better result. The overall evaluation is represented as a value at five levels with the value of Comparative Example 11 being a reference value 3. The higher the value is, the better the result is.

TABLE 4

| Evaluation Results | Ex. 4 | Comp. Ex. 11 | Comp. Ex. 12 | Comp. Ex. 13 | Comp. Ex. 14 |
|---|---|---|---|---|---|
| Tennis racket | N | P | Q | R | S |
| Longitudinal strings | Uniform | Sparse and dense | Uniform | Sparse and dense | Sparse and dense |
| Transverse strings | Sparse and dense | Sparse and dense | Uniform | Uniform | Sparse and dense |

TABLE 4-continued

| Evaluation Results | | | | | | |
|---|---|---|---|---|---|---|
| | | Ex. 4 | Comp. Ex. 11 | Comp. Ex. 12 | Comp. Ex. 13 | Comp. Ex. 14 |
| Ratio S/Sc | M1 | 1.64 | 1.31 | 1.00 | 1.00 | 1.51 |
| | M3 | 1.38 | 1.18 | 1.00 | 1.00 | 1.38 |
| | M6 | 1.15 | 1.09 | 1.00 | 1.00 | 1.15 |
| | M9 | 1.00 | 1.00 | 1.00 | 1.00 | 1.00 |
| | M12 | 1.05 | 1.05 | 1.00 | 1.00 | 1.18 |
| | M15 | 1.38 | 1.23 | 1.00 | 1.00 | 1.38 |
| | M18 | 1.55 | 1.35 | 1.00 | 1.00 | 1.55 |
| Sweet area | | 100 | 50 | 25 | 0 | 75 |
| Vibration | | 100 | 50 | 0 | 0 | 75 |
| Spin | | 100 | 50 | 0 | 33 | 0 |
| Overall evaluation | | 5 | 3 | 1 | 2 | 3 |

In the tennis racket N of Example 4, the area Sc of the center mesh was made relatively large while the ratio (St/Sc) was made great. Accordingly, the tennis racket N of Example 4 has excellent vibration absorption at a wide ball-hitting face from the vicinity of the center to the vicinity of the tip. The tennis racket N also has excellent ease of providing spin. The tennis racket N is highly rated as compared to the tennis rackets of the Comparative Examples. From the evaluation results, advantages of the present invention are clear.

The method described above can be applied to a wide range of rackets for regulation-ball tennis.

The above descriptions are merely illustrative examples, and various modifications can be made without departing from the principles of the present invention.

What is claimed is:

1. A tennis racket in which longitudinal strings extending in a longitudinal direction and transverse strings extending in a transverse direction intersect each other to form a plurality of meshes, wherein at a center, in the transverse direction, of a head, a ratio of an area St of a tip mesh located closest to a tip in the longitudinal direction relative to an area Sc of a center mesh located at a center in the longitudinal direction is not less than 1.6, and the center mesh is formed in a rectangular shape having short sides in the longitudinal direction and long sides in the transverse direction, wherein pitches between the longitudinal strings are constant from one end toward the other end of the tennis racket in the transverse direction.

2. The tennis racket according to claim 1, wherein, from the center mesh to the tip mesh, an area of each mesh is set so as to be not larger than an area of a mesh adjacent thereto at a tip side.

3. The tennis racket according to claim 2, wherein when resilience amounts at positions at which a distance Y from a top of the head is 6 cm, 9 cm, 12 cm, and 15 cm are denoted by $Hb_6$, $Hb_9$, $Hb_{12}$, and $Hb_{15}$, respectively, among the resilience amounts $Hb_6$, $Hb_9$, $Hb_{12}$, and $Hb_{15}$, a minimum resilience amount is not less than 0.98 times of a maximum resilience amount.

4. The tennis racket according to claim 2, wherein the area Sc of the center mesh is not less than 70 $mm^2$.

5. The tennis racket according to claim 2, wherein a number of the longitudinal strings is not less than 16 and not greater than 18, and a number of the transverse strings is not less than 18 and not greater than 20.

6. The tennis racket according to claim 1, wherein, from the center mesh to the tip mesh, the area of the mesh gradually increases from the center toward the tip.

7. The tennis racket according to claim 6, wherein when resilience amounts at positions at which a distance Y from a top of the head is 6 cm, 9 cm, 12 cm, and 15 cm are denoted by $Hb_6$, $Hb_9$, $Hb_{12}$, and $Hb_{15}$, respectively, among the resilience amounts $Hb_6$, $Hb_9$, $Hb_{12}$, and $Hb_{15}$, a minimum resilience amount is not less than 0.98 times of a maximum resilience amount.

8. The tennis racket according to claim 6, wherein the area Sc of the center mesh is not less than 70 $mm^2$.

9. The tennis racket according to claim 1, wherein when resilience amounts at positions at which a distance Y from a top of the head is 6 cm, 9 cm, 12 cm, and 15 cm are denoted by $Hb_6$, $Hb_9$, $Hb_{12}$, and $Hb_{15}$, respectively, among the resilience amounts $Hb_6$, $Hb_9$, $Hb_{12}$, and $Hb_{15}$, a minimum resilience amount is not less than 0.98 times of a maximum resilience amount.

10. The tennis racket according to claim 1, wherein the area Sc of the center mesh is not less than 70 $mm^2$.

11. The tennis racket according to claim 1, wherein a number of the longitudinal strings is not less than 16 and not greater than 18, and a number of the transverse strings is not less than 18 and not greater than 20.

12. A tennis racket in which longitudinal strings extending in a longitudinal direction and transverse strings extending in a transverse direction intersect each other to form a plurality of meshes, wherein at a center, in the transverse direction, of a head, a ratio of an area St of a tip mesh located closest to a tip in the longitudinal direction relative to an area Sc of a center mesh located at a center in the longitudinal direction is not less than 1.6, and the center mesh is formed in a rectangular shape having short sides in the longitudinal direction and long sides in the transverse direction, wherein when resilience amounts at positions at which a distance Y from a top of the head is 6 cm, 9 cm, 12 cm, and 15 cm are denoted by $Hb_6$, $Hb_9$, $Hb_{12}$, and $Hb_{15}$, respectively, among the resilience amounts $Hb_6$, $Hb_9$, $Hb_{12}$, and $Hb_{15}$, a minimum resilience amount is not less than 0.98 times of a maximum resilience amount.

13. The tennis racket according to claim 12, wherein, from the center mesh to the tip mesh, an area of each mesh is set so as to be not larger than an area of a mesh adjacent thereto at a tip side.

14. The tennis racket according to claim 12, wherein, from the center mesh to the tip mesh, the area of the mesh gradually increases from the center toward the tip.

15. The tennis racket according to claim 12, wherein the area Sc of the center mesh is not less than 70 $mm^2$.

16. A tennis racket in which longitudinal strings extending in a longitudinal direction and transverse strings extending in a transverse direction intersect each other to form a plurality of meshes, wherein at a center, in the transverse direction, of a head, a ratio of an area St of a tip mesh located closest to a tip in the longitudinal direction relative to an area Sc of a center mesh located at a center in the longitudinal direction is not less than 1.6, and the center mesh is formed in a rectangular shape having short sides in the longitudinal direction and long sides in the transverse direction, wherein a number of the longitudinal strings is not less than 16 and not greater than 18, and a number of the transverse strings is not less than 18 and not greater than 20.

17. The tennis racket according to claim 16, wherein, from the center mesh to the tip mesh, an area of each mesh is set so as to be not larger than an area of a mesh adjacent thereto at a tip side.

18. The tennis racket according to claim 16, wherein, from the center mesh to the tip mesh, the area of the mesh gradually increases from the center toward the tip.

19. The tennis racket according to claim 16, wherein the area Sc of the center mesh is not less than 70 $mm^2$.

* * * * *